US006029867A

United States Patent [19]

Lee

[11] Patent Number: 6,029,867

[45] Date of Patent: Feb. 29, 2000

[54] APPARATUS FOR WINDING ROUND THE STEM OF A BUTTON

[76] Inventor: Uk Jae Lee, 303ho 899-4 BonO-dong, Ansan-shi, Kyongki-do, Ansan-shi, Rep. of Korea, 425-180

[21] Appl. No.: 09/043,980

[22] PCT Filed: Jul. 29, 1996

[86] PCT No.: PCT/KR96/00124

§ 371 Date: Mar. 30, 1998

§ 102(e) Date: Mar. 30, 1998

[87] PCT Pub. No.: WO97/04674

PCT Pub. Date: Feb. 13, 1997

[30] Foreign Application Priority Data

Jul. 28, 1995 [KR] Rep. of Korea ..... 95-22804

[51] Int. Cl.[7] ..... A41H 43/00

[52] U.S. Cl. ..... 223/1; 2/265

[58] Field of Search ..... 223/1; 2/265; 112/108, 112/110

[56] References Cited

U.S. PATENT DOCUMENTS 4,426,942 1/1984 Nestenius ..... 112/108

5,082,151 1/1992 Schrarer ..... 223/1

*Primary Examiner*—Bibhu Mohanty

*Attorney, Agent, or Firm*—Jacobson, Price, Holman & Stern, PLLC

[57] ABSTRACT

An apparatus for winding round the stem of a button is disclosed wherein the drawbacks of the prior invention disclosed in U.S. Pat. No. 5,082,151 were settled. Namely, after drawing the winding thread from the bobbin and in the process of the winding operation, if the thread is recoiled and drawn, the tensile force of the thread decreases and during the winding operation maintaining high rotation speed, the thread is frequently cut off, which leads to the frequent interruption of the winding operation. It was very inefficient in the respect of operation and had impractical disadvantage.

Such apparatus according to the present invention comprises a bobbin supporting means for interchangeably supporting the bobbin supplying the winding thread so as to rotate on its own axis to the unloosening direction of the thread in accordance with winding and drawing force of the thread, a thread winding means being fixedly mounted on the equal rotation axis to said bobbin supporting means for receiving from the bobbin the winding thread and winding it round the stem of the button while being rotated along with the bobbin in the equal direction and at the equal angular velocity, and a winding rotation means for rotatively mounting on the support the bobbin supporting means and the thread winding means being fixedly mounted on equal rotation axis and rotating it with driving force of a motor.

7 Claims, 4 Drawing Sheets

APPARATUS FOR WINDING ROUND THE STEM OF A BUTTON

TECHNICAL FIELD

The present invention relates to an apparatus for winding round a stem of a button, and more particularly to the apparatus for winding round the stem of the button in which a winding thread is wound with some tension round the stem of the button sewn by a sewing thread to an article of clothing.

BACKGROUND ART

The ordinary synthetic thread can not be used to the conventional the apparatus for winding round a stem of a button so as to mechanical characteristics.

The conventional example of the apparatus for winding round the stem of the button is disclosed in the contents of U.S. Pat. No. 5,082,151 (hereinafter referred to as the "prior invention").

The conventional apparatus for winding round the stem of the button disclosed in the prior invention comprises a winding bell for winding a thread, a winding bell drive motor having a axis with the drive motor spaced from said winding bell, said drive motor has a arranged for the winding thread to be passed therethrough to the winding bell, said hollow shaft having an axis, and a magazine for receiving a winding thread supply, wherein said winding bell, the drive motor having the hollow shaft and the magazine being comined to form a hand-operated device.

According to the construction of such the hand-operated device, it had the advantages which the end of the winding thread is definitely fixed to coil of the button stem and the button is sewn more economically than when using a stationary stem winding apparatus. Such said apparatus especially had the advantages which can be particularly compact and easily handleable when the magazine is constructed with a handle type.

An apparatus for winding round the stem of the button of an article of clothing can have a very compact construction in whole by mounting the winding bell, the drive motor and the magazine on identical axis, or mounting the magazine at right angles to the common axis of the winding bell and the drive motor so as to form indirect drive connection relation with the winding bell by means of a mitre gear. Said apparatus can be easily and actually handleable by wrapping a casing on the drive motor so as to use it as a handle.

However, said construction had the following drawbacks concerning actual use when the winding operation is conducted.

The hand-operated device of first embodiment in FIG. 3 illustrating the prior invention the conventional apparatus is constructed such that an electric motor drives the winding bell through a hollow shaft axis, the winding thread is drawn from a bobbin of the common axis located at the magazine, through the hollow shaft, is passed to the winding bell, is gone through the edge of the winding bell, and is wound round the thread bundle periphery of the stem of the button according to rotation of the winding bell. The winding thread which is wound in a semi-coniform bobbin mounted on the hollow axis and the common axis is coiled and unloosened, as it is unloosened to the side of angular point when drawn to the hollow shaft of the drive motor.

This thread is connected again from the hollow shaft to the edge of the winding bell. It is recoiled and drawn according to the rotation of the winding bell.

As such, after drawing the winding thread from the bobbin and in the process of the winding operation, if the thread is recoiled and drawn, the tensile force of the thread decreases and during the winding operation maintaining high rotation speed, the thread is frequently cut off, which leads to the frequent interruption of the winding operation. Namely, as it hinders the general characteristics required for continuous treatment of a given quantity of clothing, it is very inefficient in the respect of operation efficiency and has impractical disadvantage.

Especially if the thread is wound round the shape of the button in its recoiled state, the periphery of the thread wound is formed knaggy, and thus it had the drawbacks leading to friction and easy wear in a buttonhole while using the clothing.

Further, as shown on the other example of the second embodiment shown on FIG. 4 of the prior invention, the hollow shaft is rotatively mounted in a gear casing, the end edge of the hollow shaft is guided from the gear casing, at one end the winding bell is fixed and at the other end the magazine receiving a supply part of the winding thread is located, the magazine is constructed with a bobbin carrier fixed in the gear casing and a supply bobbin for the winding thread, this bobbin is located at right angles to the axis of the hollow shaft and is inserted into the bobbin carrier in a rotative and interchangeable way, and the thread which left the bobbin finally goes through a ring provided on the circumference of a circle of the winding bell through the hollow shaft and a slot formed on a wall of the winding bell.

With such construction, when the winding thread wound round the supply bobbin is unloosened and drawn to the hollow shaft, the thread is unloosened from the side of the bobbin while the supply bobbin is rotating on its own axis, and thus first-stage coiling phenomenon is settled. However, the thread being drawn by going through the hollow shaft, the slot formed on the wall of the winding bell and the ring provided on the circumference of the circle of the winding bell is coiled and drawn in the process of going through the hollow shaft and being supplied to the ring, and thus the degree of coiling is somewhat reduced in comparison with the apparatus of said first embodiment but has the drawbacks similar to those of the apparatus of the first embodiment due to the surviving coiling phenomenon.

DISCLOSURE OF INVENTION

The present invention relates to an apparatus for winding round the stem of a button, and more particularly to the apparatus for winding round the stem of the button in which a winding thread is wound with some tension round the stem of the button sewn by a sewing thread to an article of clothing.

An object of the present invention is to provide the apparatus for winding round the stem of the button enabling to settle the phenomena of coiling and cutting off of the winding thread during the winding operation which is the drawback of the conventional apparatus for winding round the stem of the button.

Another object of the present invention is to provide the apparatus for winding round the stem of the button in which the thread being wound round the stem of the button in relation to the aforesaid object is not coiled in itself and thus even shape of periphery on a thread bundle is formed.

A further object of the present invention is to provide the apparatus for winding round the stem of the button in which by preventing the winding thread from being coiled, an ordinary synthetic thread such as Draw textured yarn or sewing twisted thread in consist of polyester having low percentage of elongation and low-priced can be used as the winding thread.

The apparatus for winding round the stem of the button according to the present invention which was conceived to accomplish the aforementioned objects comprises a bobbin supporting means for interchangeably supporting the bobbin supplying the winding thread so as to rotate on its own axis to the unloosening direction of the thread in accordance with winding and drawing force of the thread, a thread winding means being fixedly mounted on the equal rotation axis to said bobbin supporting means for receiving from the bobbin the winding thread and winding it round the stem of the button while being rotated along with the bobbin in the equal direction and at the equal angular velocity, and a winding rotation means for rotatively mounting on the support the bobbin supporting means and the thread winding means being fixedly mounted on equal rotation axis and rotating it with driving force of a motor.

According to the present invention, the winding thread being supplied from the bobbin is smoothly supplied in a forward direction without any coiling during the supply process until it is wound round the stem of the button, and thus interruption phenomenon of winding operation resulting from cutting off of the winding thread was originally prevented.

It leads to great improvement of operation efficiency, evenly formed periphery of the thread bundle wound round the stem of the button, and the supply of the winding thread without any coiling.

These advantages enable to maintain the tensile force of the thread being supplied, and to efficiently perform the winding operation having no cutting off by means of the ordinary synthetic thread of a moderate price instead of using the material of the winding thread such as Elasthan fibers which is the elastomeric plastics material of an expensive price and high percentage of elongation so that the winding operation can be conducted with very inexpensive cost.

Other objects and advantages will be apparent from the accompanied brief description of drawings and best mode for carrying out the invention to be described hereinafter.

BEST MODE FOR CARRYING OUT THE INVENTION

Figure 1:
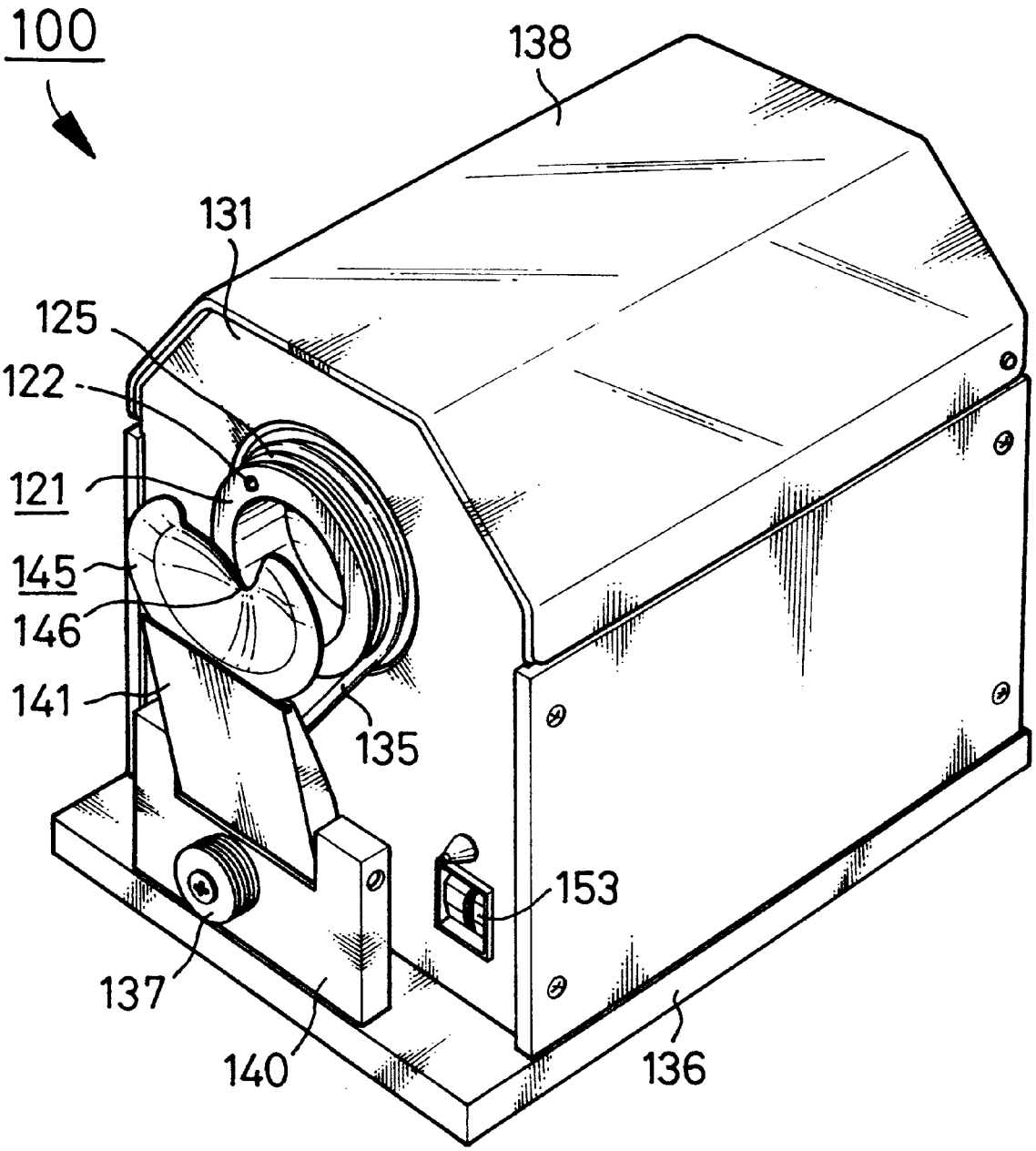
FIG. 1 is an external view of a stationary apparatus for winding round the stem of a button according to one example of the present invention.
Figure 2:
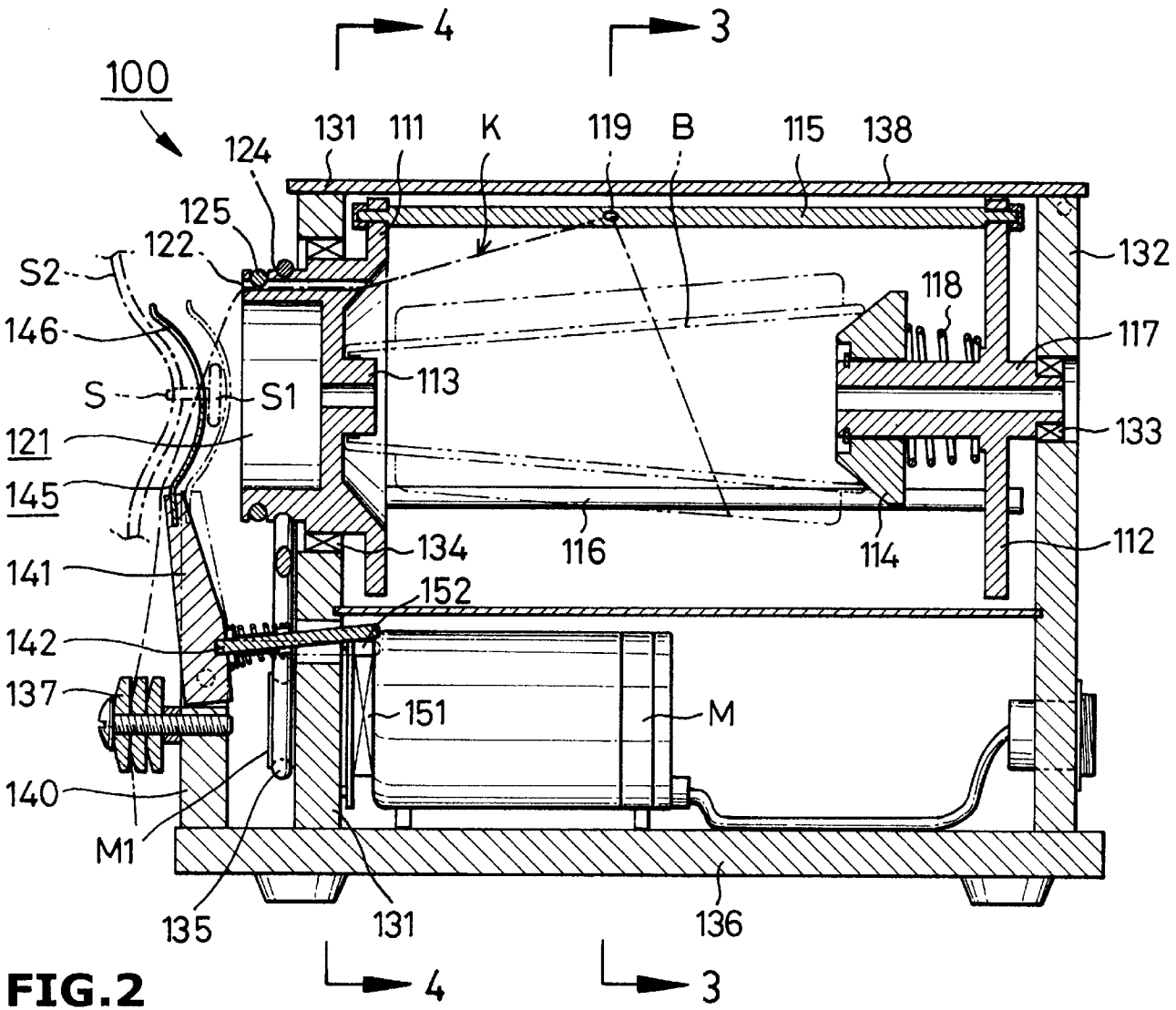
FIG. 2 is a sectional view of the apparatus for winding round the stem of a button according to an example of the present invention.
Figure 3:
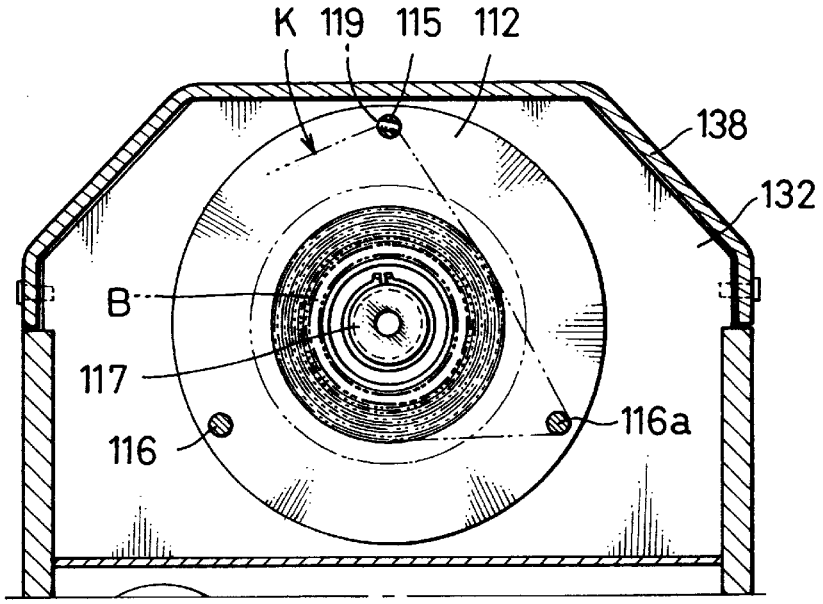
FIG. 3 is a section view taken on line 3—3 of FIG. 2.
Figure 4:
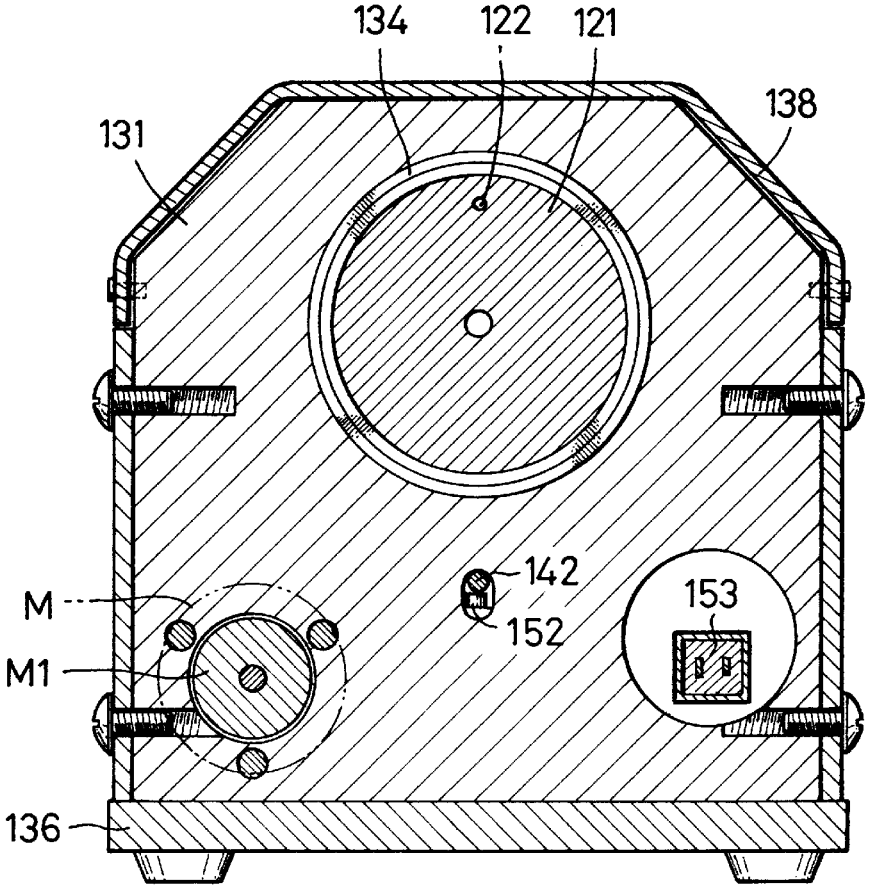
FIG. 4 is a section view taken on line 4—4 of FIG. 2.

As shown on from FIG. 1 to FIG. 4, the apparatus 100 for winding round the stem of the button according to one example of the present invention comprises a bobbin supporting device having a bobbin supporting member for replaceably supporting a bobbin (B) supplying a winding thread (K) so as to rotate on its own axis to the unloosening direction of the thread in accordance with winding and drawing force of the thread and a thread guide member for guiding the thread being winded to the bobbin (B) to the loosening direction of the thread, a thread winding device being fixedly mounted on the equal rotation axis to said bobbin supporting device for receiving from the bobbin the winding thread and winding it round the stem of the button while being rotated along with the bobbin in the equal direction and at the equal angular velocity, and a winding rotation device for rotatively mounting on a base plate 136 the bobbin supporting device and the thread winding device being fixedly mounted on equal rotation axis and rotating it with driving force of a motor.

Said bobbin supporting device comprises a front disc 111 having an outer side edge being integrally fixed with the thread winding device and a bobbin supporter 113 supporting one side edge of the bobbin (B), a rear disc 112 being connected with said front disc 111 by means of several connection rods 115, 116, 116*a* and being fixedly mounted by passing through a central part of a vertical hem of a shaft 117 rotatively mounted on a rear supporter 132, a bobbin supporter 114 having the other side edge of he bobbin (B) being elastically mounted with a spring 118 on the vertical hem of the shaft 117 from the inner side edge of said rear disc 112, and a thread guide hole 119 being mounted at outer side of the middle part of said one side connection rod 115 for guiding the winding thread (K) being unloosened from the bobbin (B).

Said thread winding device comprises the construction that at central part being formed with a cylindrical shape in which a button stem (S) can be led, at rear end being integrally fixed on equal axis to said front disc 111, at middle part being rotatively mounted on the axis to a front supporter 131, at front side having a pulley groove 123 interlocking a driving pulley (M1) of the winding rotation device, at one side edge being formed with a leading hole 122 through which the winding thread (K) is supplied by passing through front and rear along with one side of the front disc 111, and at one end of said leading hole 122 being formed with a groove wheel 124 so that drawing tension can be adjusted by pressing one end of the winding thread (K) and having a thread winding member 121 along which a tension ring 125 is mounted.

Said winding rotation device comprises the front supporter 131 rotatively and pivotally mounting rear end of the thread winding member 121 with a bearing 134, the rear supporter 132 rotatively and pivotally mounting rear end of the shaft 117 fixedly mounted on an axis to the rear disc 112 of a bobbin supporting device with a bearing 133, a base plate 136 supporting said front and rear supporters 131, 132, a motor (M) having a driving pulley (M1) fixed at one side of said base plate 136, a motor transmission belt 135 interlocking said driving pulley (M1) and a pulley groove 123 of the thread winding member 121, and a thread end holder 137 being fixedly mounted on one side of front of the base plate 136 and holding by drawing with tension the winding thread (K) led in the leading hole 122 of the thread winding member 121.

The numeral 138 is cover, 140 is fixed member, 141 is switch panel, 142 is switch rod, 145 is plate, 146 is slot, 151 is control device P.C.B, 152 is start switch, and the numeral 153 is speed control switch.

Operation state of the apparatus for winding round the stem of the button is explained in the following.

The bobbin (B) having the winding thread (K) is mounted on the front and rear bobbin supporters 113, 114 being formed on its rotation central axis between the front and rear discs 111, 112 so as to rotate on its axis with some tension around front and rear portions, and to have its angular point facing the front side.

The thread unloosened out of the thread end from this bobbin (B) is rolled the outer surface of one side connection rod 116 of three connection rods 115, 116, 116*a* connecting with and supporting front and rear disc 111, 112 is gone through a thread guide hole 119 of another side connection rod 115 and is led into the front through the leading hole 122.

The end of winding thread (K) drawn through the leading hole 122 from the edge of the thread winding member 121 is drawn and held to the thread end holder 137 separately prepared at one lower side of the base plate 136 for the preparation of winding operation of the button stem (S). The predetermined winding operation is conducted in the publicly known method. Namely, if the button stem (S) of a clothing (S2) to be wound is put in the middle part of the thread winding member 121 and the motor (M) is activated, the thread winding member 121 conducts the winding operation while intermittently rotating clockwise several times.

According to such winding operation, the thread winding member 121 is rotated and thus the bobbin supporting device being attached integrally to the rear end of the thread winding member 121 and being integrally and rotatively mounted between the front supporter 131 and the rear supporter 132 is rotated in equal direction and with equal turning effect at the same time.

Also, the bobbin (B) supported under some tension with the bobbin supporters 113, 114 in the bobbin supporting device is rotated while turning on its own axis. Accordingly, even if the winding thread (K) is drawn from the edge of the thread winding member 121 to the leading hole 122 according to the speed of winding operation, the position and direction which the winding thread (K) is unloosened from the bobbin (B) become the side unloosening direction which the thread is unloosened with the thread guide hole 119 prepared in the middle part of one side connection rod 115 without being coiled in itself, by virtue of drawing force of the winding thread, the winding thread is unloosened while the bobbin (B) is turning on its axis to the bobbin supporters 113, 114, and at the same time, along with the thread winding member 121 the bobbin is rotated so as to obtain the operation effects which the winding thread is supplied without entirely being coiled.

As explained in the above, as the winding thread (K) is not entirely coiled in various devices from the process being unloosened until being wound round the button stem (S), it is unloosened and flexibly supplied under some tension in accordance with the speed of winding operation.

Namely, it basically settles the drawback, the greatest disadvantage of a bobbin stationary winding apparatus according to the aforesaid conventional prior invention which as the winding thread is doubly coiled and supplied, the thread is cut off during the winding operation to cause the interruption of the operation. It has the practical advantages which can heighten the operation efficiency and effectiveness by raising characteristics of the winding apparatus purporting to continuously deal with the clothing of any quantity. Further, it enables to evenly form the periphery of the thread bundle wound round the button stem by smoothly supplying in forward direction without being entirely coiled in supply process from the time when the winding thread (K) is unloosened until it is wound round the button stem.

Also, as the winding thread is supplied without being entirely coiled, it can be smoothly supplied even if its tensile force is weak. Accordingly, it has another advantage to effectively perform the winding operation at very inexpensive costs by using the ordinary synthetic thread of a moderate price instead of using the material of the winding thread such as Elasthan fibers which is the elastomeric plastics material of an expensive price and high percentage of elongation.

Figure 5:
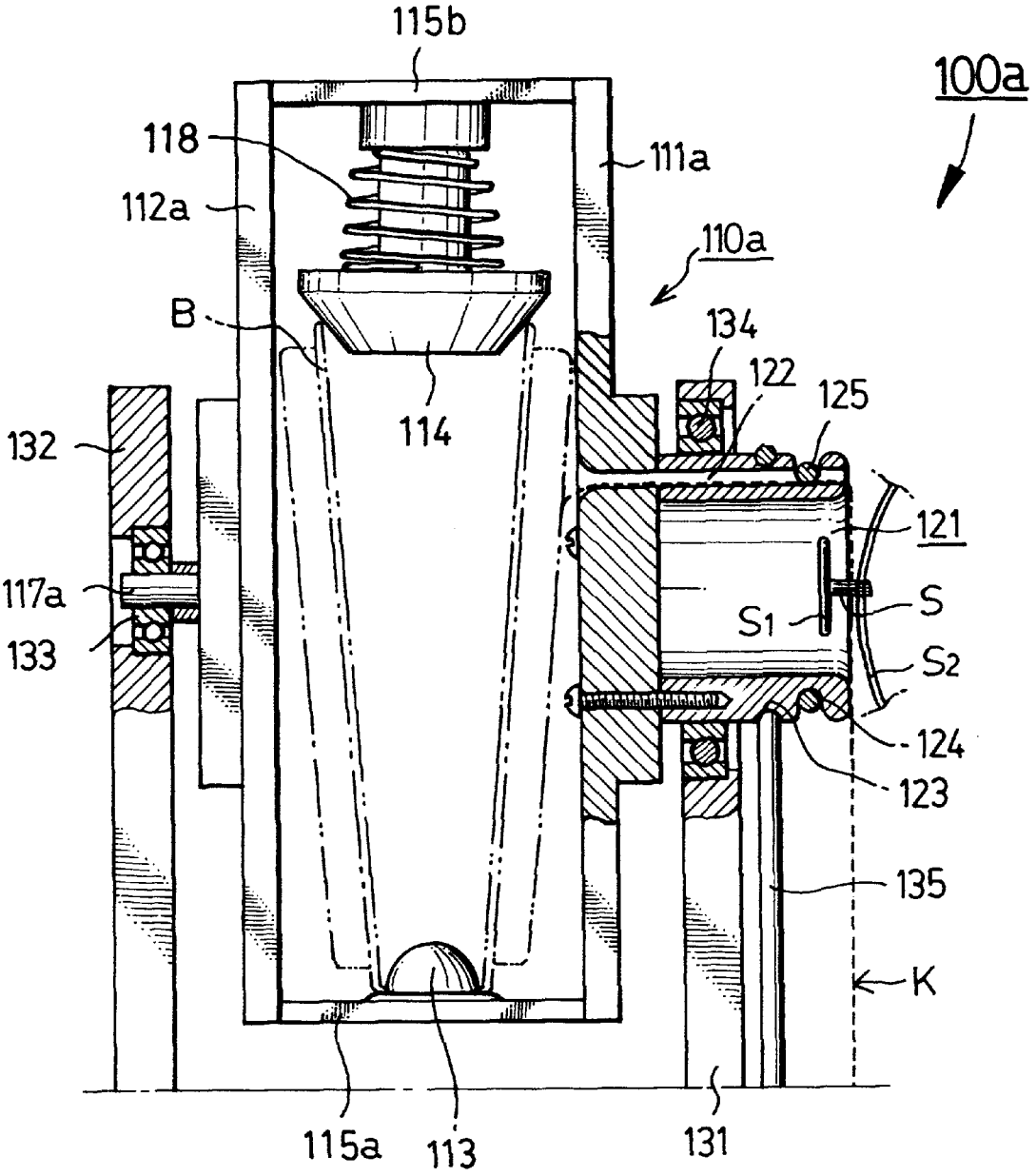
FIG. 5 is a sectional view of the apparatus for winding round the stem of the button according to another example of the present invention.

FIG. 5 is the apparatus (100*a*) for winding round the button stem according to another example of the present invention.

In this example, what is different from the construction of the aforesaid apparatus 100 for winding round the button stem is only the construction of a bobbin supporting device.

The bobbin supporting device comprises a front disc (111*a*) of a long shape to one side, at outer side edge of middle part which the thread winding device is integrally fixed, a rear disc (112*a*) being symmetrically formed to said front disc (111*a*) and having outer side edge of middle part being rotatively mounted on its rotation axis (117*a*) to the rear supporter 132, top and bottom bobbin fixing plates (115*a*) (115*b*) fixing said front disc (111*a*) and rear disc (112*a*) at top and bottom respectively and supporting the bobbin (B), the bobbin supporter 113 having at inner side edge of the top bobbin fixing plate (115*a*) one side edge of the bobbin (B) being inserted and mounted on its axis with such construction as to rotatively support the bobbin (B) between the top and bottom bobbin fixing plates (115*a*) (115*b*), and the bobbin supporter 114 having at inner side edge of the bottom bobbin fixing plate (115*b*) the other side edge of the bobbin (B) being mounted on its axis with the spring 118 under tension.

According to such the bobbin supporting device, the thread winding member 121 is rotated, thus the bobbin supporting device being integrally attached to rear end of the thread winding member 121 and being rotatively mounted on its axis between the front supporter 131 and the rear supporter 132 is rotated in the equal direction and at the equal angular velocity, the bobbin (B) supported with the bobbin supporters 113, 114 under a certain tension in the bobbin supporting device can turn by itself and at the same time, rotate together with the bobbin supporting device. In this case, as turning axis of the bobbin is formed to cross at right angles to the rotation axis of the bobbin supporting device (110*a*), the winding thread (K) wound on the bobbin (B) is unloosened, without coiling, right from the bobbin (B) turning on its own axis without through the thread guide hole 119 prepared in the middle side of the separate connection rod 115, while being unloosened with winding and driving force, as illustrated on one example so that the winding thread (K) can be supplied to the leading hole 122 formed at the edge of the thread winding member 121 during the winding operation. These operation and effects will enable to accomplish the object of the present invention in the same manner as that in the aforesaid one example.

The construction of one example described in detail in embodying the present invention is presented as one desirable example, but the present invention is not restricted thereto.

The construction of the winding rotation device which is a means for rotating the bobbin supporting device integrally attached to the thread winding member of the thread winding apparatus comprises the construction, as shown on one example, which a motor is indirectly driven with the driving pulley, etc., by mounting on the other axis to the rotation axis of the thread winding device, and in addition to such construction, equal effects can be obtained, too, when mounting by way of direct driving on either side of front or rear on the identical axis to the rotation axis of the thread winding member and bobbin supporting device.

I claim:

1. An apparatus for winding round the stem of a button by supplying an ordinary synthetic thread without coiling for a winding thread comprising:

a bobbin supporting means having a bobbin supporting member for replaceably supporting a bobbin supplying a winding thread so as to rotate on its own axis to the unloosening direction of the thread in accordance with winding and drawing force of the thread and a thread guide member for guiding the thread being winded to the bobbin to the loosening direction of the thread, a thread winding means being fixedly mounted on the equal rotation axis to said bobbin supporting means for receiving from the bobbin the winding thread and winding it round the stem of the button while being rotated along with the bobbin in the equal direction and at the equal angular velocity, and a winding rotation means for rotatively mounting on the support the bobbin supporting means and the thread winding means being fixedly mounted on equal rotation axis and rotating it with driving force of a motor.

2. An apparatus for winding round the stem of a button, as set forth in claim 1, wherein said bobbin supporting means is a bobbin supporting device comprising:

a front disc 111 having an outer side edge being integrally fixed with the thread winding means and a bobbin supporter 113 supporting one side edge of the bobbin (B), a rear disc 112 being connected with said front disc 111 by means of several connection rods (115) (116) **(116*a*) and being fixedly mounted by passing through a middle part of a vertical hem of a shaft 117 rotatively mounted on a rear supporter 132, a bobbin supporter 114 having the other side edge of the bobbin (B) being elastically mounted with a spring 118 on the vertical hem of the shaft 117 from the inner side edge of said rear disc 112, and said one side connection rod 115 having a thread guide hole 119** being mounted at middle part.

3. An apparatus for winding round the stem of a button, as set forth in claim 1, wherein said thread winding means being fixedly mounted on the equal rotation axis to said bobbin supporting means for receiving from the bobbin the winding thread and winding it round the stem of the button while being rotated along with the bobbin in the equal direction and at the equal angular velocity comprises:

a thread winding device at central part being formed with a cylindrical shape in which the button stem can be led, at rear end being integrally fixed on equal axis to said front disc 111, at middle part being rotatively mounted on the axis to a front supporter 131, at front side having a pulley groove 123 interlocking a driving pulley of the winding rotation means, at one side edge being formed with a leading hole 122 through which the winding thread (K) is supplied by passing through front and rear along with one side of the front disc 111, and at one end of said leading hole 122 being formed with a groove wheel 124 so that drawing tension can be adjusted by pressing one end of the winding thread (K) and having a thread winding member 121 along which a tension ring 125 is mounted.

4. An apparatus for winding round the stem of a button, as set forth in claim 1, said winding rotation means is a winding rotation device comprising:

a front supporter 131 rotatively and pivotally mounting rear end of the thread winding member 121 with a bearing 134, a rear supporter 132 rotatively and pivotally mounting rear end of the shaft 117 fixedly mounted on an axis to the rear disc 112 of a bobbin rotation device with a bearing 133, a base plate 136 supporting said front and rear supporters 131, 132, and a motor (M) having a driving pulley (M1) fixed at one side of said base plate 136, a transmission belt 135 interlocking said driving pulley (M1) and a pulley groove 123 of the thread winding member 121.

5. An apparatus for winding round the stem of a button, as set forth in claim 1, wherein said bobbin supporting means is a bobbin supporting device **(110*a*)** comprising:

a front plate **(111*a*) of a long shape to one side, at outer side edge of middle part which the thread winding device is integrally fixed, a rear plate (112*a*) being symmetrically formed to said front plate (111*a*) and having outer side edge of middle part being rotatively mounted on its rotation axis (117*a*) to the rear supporter 132, top and bottom bobbin fixing plates (115*a*) (115*b*) fixing said front plate (111*a*) and rear plate (112*a*) at top and bottom respectively and supporting the bobbin (B), a bobbin supporter 113 having at inner side edge of the top bobbin fixing plate (115*a*) one side edge of the bobbin (B) being inserted and mounted on its axis with such construction as to rotatively support the bobbin (B) between the top and bottom bobbin fixing plates (115*a*) (115*b*), and a bobbin supporter 114 having at inner side edge of the bottom bobbin fixing plate (115*b*) the other side edge of the bobbin (B) being mounted on its axis with the spring 118** under tension.

6. An apparatus according to claim 1, wherein the winding thread means, the bobbin supporting means and the winding rotation means are arranged equiaxially.

7. An apparatus according to claim 1, wherein an ordinary synthetic thread is the thread being used.

* * * * *